US005562156A

United States Patent [19]

Ogawa et al.

[11] Patent Number: 5,562,156

[45] Date of Patent: Oct. 8, 1996

[54] IMMERSION TYPE HEAT EXCHANGER

[75] Inventors: Hiromu Ogawa; Michio Hashida, both of Tokyo; Kiyoshi Kawasaki, Nara, all of Japan

[73] Assignee: Ohmiya Corporation, Japan

[21] Appl. No.: 385,833

[22] Filed: Feb. 9, 1995

[30] Foreign Application Priority Data

Feb. 10, 1994 [JP] Japan ..... 6-036337

[51] Int. Cl.[6] ..... F28F 21/02

[52] U.S. Cl. ..... 165/133

[58] Field of Search ..... 165/133, 905

[56] References Cited

U.S. PATENT DOCUMENTS

| | | | |
|---|---|---|---|
| 2,923,640 | 2/1960 | Buckingham | 165/133 |
| 3,310,102 | 3/1967 | Trombe | 165/133 |
| 3,424,238 | 1/1969 | Leeds et al. | 165/133 |
| 4,125,152 | 11/1978 | Kestner et al. | 165/133 |
| 4,296,804 | 10/1981 | Press et al. | 165/133 |
| 4,461,347 | 7/1984 | Layton et al. | 165/133 |
| 4,503,907 | 3/1985 | Tanaka et al. | 165/133 |
| 4,515,210 | 5/1985 | Smith et al. | 165/133 |
| 4,738,307 | 4/1988 | Bentley | 165/133 |
| 5,199,486 | 4/1993 | Balmer et al. | 165/133 |
| 5,211,220 | 5/1993 | Swozil et al. | 165/133 |

*Primary Examiner*—Edward K. Look
*Assistant Examiner*—Mark Sgantzos
*Attorney, Agent, or Firm*—Rogers & Killeen

[57] ABSTRACT

The present invention provides a heat exchanger having a coating with durability which causes neither adhesion of sludge nor separation of the coating within a short time. The surface of the heat exchanger is coated with a fluororesin having excellent chemical resistance and characteristics in that the hardness is R96 or more, the taper abrasion is less than 8.7 mg, the linear expansion coefficient is 7.5 to $8.0\times10^{-5}$/°C., and the elongation is 223 to 280%. The fluororesin is preferably poly chloro tri fluoro ethylene with 1–2 weight percent cobalt.

9 Claims, 2 Drawing Sheets

IMMERSION TYPE HEAT EXCHANGER

BACKGROUND OF THE INVENTION

1. Field of the Invention

The present Invention relates to an immersion type heat exchanger used in a state where it is immersed in a surface treatment bath in order to heat a liquid to be heated, and particularly to a heat exchanger which causes no separation of the fluororesin film coated thereon and no adhesion of sludge even if it is immersed in the treatment bath during use for a long time.

2. Description of the Related Art

When a metallic material is subjected to surface treatment by immersion in a phosphate solution, a metallic coil type heat exchanger, a plate heat exchanger or a laminated plate heat exchanger is generally used for heating the phosphate solution.

However, phosphate surface treatment has the problem that since the free iron produced in the solution adheres to the surface of the heat exchanger and is solidified into sludge with the passage of time, the thermal conduction efficiency of the surface of the heat exchanger deteriorates.

The work of removing the sludge which adheres to tile heat exchanger must thus be performed at intervals of 2 to 3 months, and the heat exchanger cannot be used during the removal work. Namely, there are not only the problem that surface treatment with a phosphate solution is impossible but also the problems that the work of removing sludge is a manual work and thus exhibits a low efficiency, and that it is increasingly difficult to secure the workers because the work is a physical work and makes dirty.

Although an attempt is made to coat a general fluororesin on the surface of the heat exchanger, the fluororesin is separated after use for about 1 to 1.5 months due to a large difference between the thermal expansion coefficients of the coated fluororesin and the surface material of the heat exchanger, and the coating effect thus deteriorates.

SUMMARY OF THE INVENTION

In consideration of the above points, an object of the present invention is to provide a heat exchanger having a coating with high durability which causes no adhesion of sludge and which is not separated within a short time.

In order to achieve the above object, a heat exchanger of the present invention comprises a fluororesin with excellent chemical resistance which is provided on the outer surface of the heat exchanger by coating and burning and which has a hardness of at least R96, a taper abrasion of less than 8.7 mg, a linear expansion coefficient of 7.5 to $8.0\times10^{-5}$/°C. and an elongation of 223 to 280%.

The coating of the fluororesin laving high hardness, abrasion resistance, elongation and linear expansion coefficient permits the formation of a surface coating layer which has high separation resistance and which prevents formation of sludge.

DESCRIPTION OF THE PREFERRED EMBODIMENTS

Figure 1:
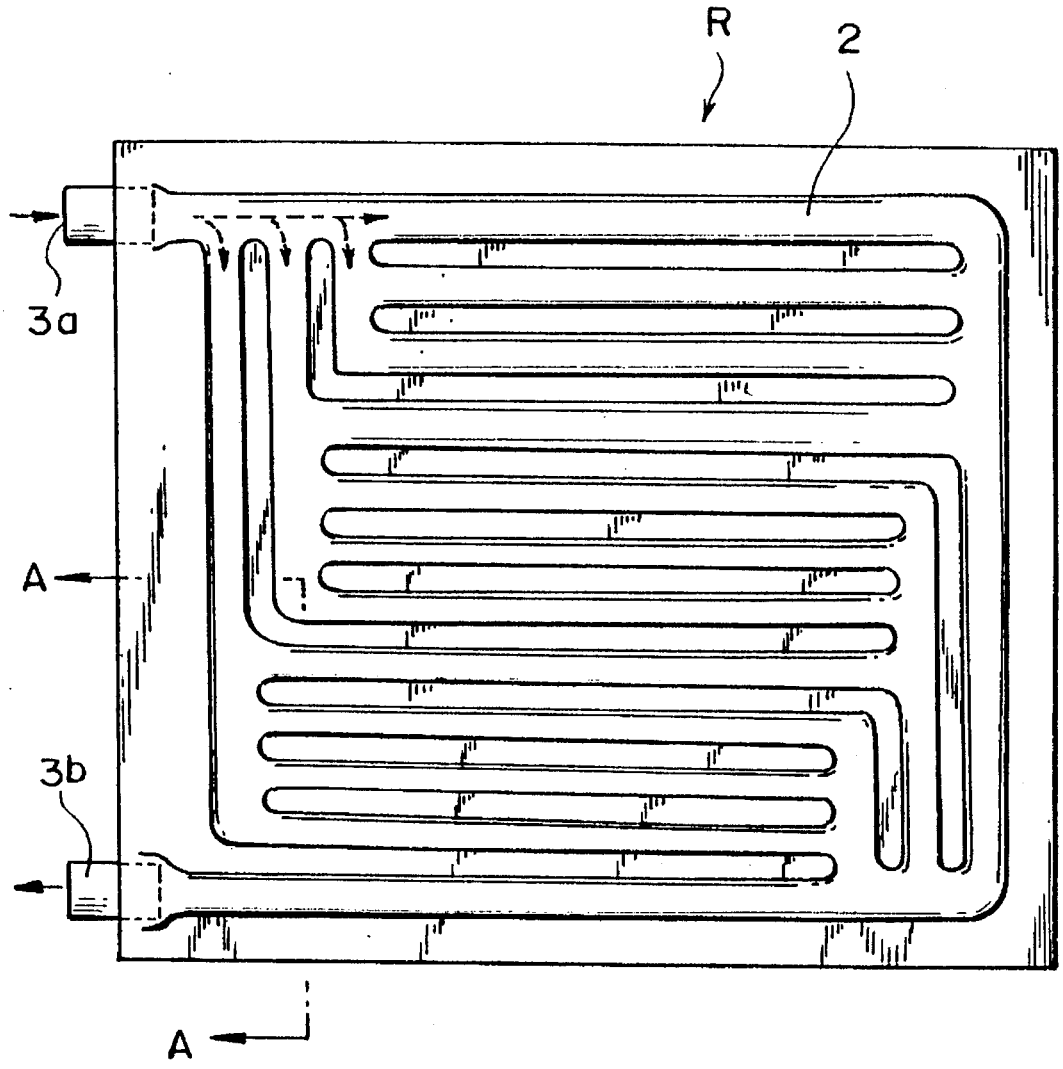
FIG. 1 is a front view of a heat exchanger in accordance with an embodiment of the present invention.
Figure 2:
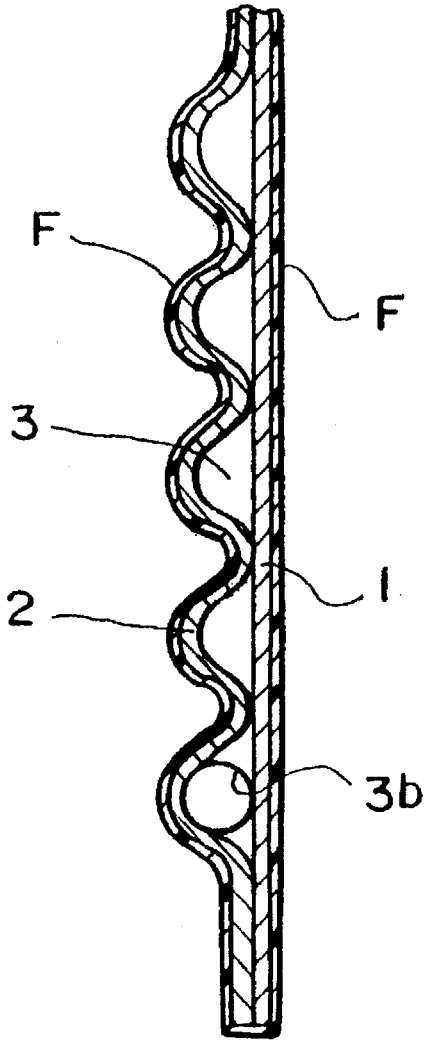
FIG. 2 is a sectional view taken along line A—A in FIG. 1.

A heat exchanger in accordance with an embodiment of the present invention is described below with reference to the drawings. FIG. 1 is a front view of a heat exchanger in accordance with an embodiment of the present invention, and FIG. 2 is a sectional view taken along line A—A in FIG. 1.

In the drawings, reference numeral 1 denotes a plate-formed rectangular flat substrate which, in this embodiment, comprises a steel plate. Reference numeral 2 denotes a passage plate having the pattern of a passage 3 on one side of the substrate 1, as shown in FIG. 1. The passage plate 2 is fixed to one side of the substrate 1 by welding or the like to form an example of a plate-formed heat exchanger R having entrances *3a* and *3b* for a heat exchange fluid.

The fluid entrances *3a* and *3b* of the plate-formed heat exchanger R are respectively connected to supply and discharge sources for the heat exchange fluid. Although a plurality of the heat exchangers R are used in the state where they are arranged in a bath for phosphate surface treatment, there is the problem that since phosphate sludge adheres to and is solidified on the surface, and deteriorates the heat exchanger effectiveness, the periodic work of removing the sludge is essential. Although, in order to solve the problem, an attempt was made to coat a known fluororesin on the surface of the heat exchanger R, it was confirmed that a conventional fluororesin causes separation of the coating or adhesion and growth of sludge within a short time during use.

In the present invention, as a result of repeated experiment and research using a heat exchanger R having outer surfaces coated with fluororesins having different characteristics, it was found that the use of a fluororesin having the characteristics below causes neither separation nor adhesion of sludge, apart from known fluororesins. This finding led to the achievement of the present invention.

The fluororesin used in coating of the heat exchanger R of the present invention has the following properties:

In the physical properties, the specific gravity is about 1.70, and the melting point is about 240° C. In the mechanical properties, the tensile strength is 478 Kg/cm$^2$ or more, the elongation is 230 to 280%, the resin is not broken in the Izod impact test, the Rockwell hardness is R96 or more, and the taper abrasion is 8.7 or less. In the thermal properties, the heat conductivity is about $4.5\times10^{-4}$ Cal/cm·sec, the specific heat is 0.44 Cal/°C./g, and the linear expansion coefficient is 7.5 to $8.0\times10^{-5}$/°C. In the electrical properties, the volume resistivity is $7.5\times10^{15}$ Ω·cm, the surface resistivity is $3\times10^{14}$ Ω, and the dielectric strength is about 31 Kv/mm (⅛ inch thickness).

The fluororesin (powder) having the above characteristics was coated three times on the outer surface of the heat exchanger R which was previously treated by alumina blasting and then burnt to form a fluororesin coating layer having a thickness of about 400 to 500μ.

The fluororesin coating layer comprised a first layer which was formed to a thickness of about 100μ on the surface of the heat exchanger R by coating a fluororesin powder having a particle size of 5 to 40μ and an average particle size of 20 to 25μ at a temperature of about 290° to 300° C., a second layer having a thickness of about 200μ and comprising a lamination layer having a thickness of about 100μ and formed on the first layer at a temperature of about 270° to 300° C. and a layer having a thickness of about 100μ and formed on the lamination layer at the same temperature, and a third layer having a thickness of about 100μ and laminated on the second layer at a temperature of about 270° to 300° C.

On the other hand, four heat exchangers which were respectively coated with known fluororesins FEP (liquid), ETFE (liquid), PTFE (liquid) and PFA (powder) by a general method, and one heat exchanger R coated with the above fluororesin of the present invention were immersed in a manganese phosphate solution, and tests were made for separation of the coating layers and adhesion of sludge for 6 months. The results obtained are shown in Table 1. Tables 2 and 3 show the characteristics of the fluororesins used in the tests.

In a preferred embodiment of the present invention, the fluororesin comprises PCTFE (poly chloro tri fluoro ethylene), desirably with a small amount of cobalt (1 to 2 weight percent): chemical formula $(CF_2—CFCl)_n$+Co. This fluororesin is commercially available under the trademark BLUE ARMOR. The coating thickness may be 350μ to 550μ, with a thickness of 400μ being used in the tests of Table 1.

TABLE 1

| Fluororesin Period Thickness | Test with manganese phosphate surface treatment solution: Comparative Example (Conventional known fluorine coating): FEP (produced by Company A) (30μ) | FEP (produced by Company B) (30μ) | ETFE (produced by Company C) (100μ) | PTFE (produced by Company D) (40μ) | PFA (produced by Company E) (100μ) | Example: Fluororesin of this Invention (400μ) |
|---|---|---|---|---|---|---|
| 1 week | Although sludge began to adhere. It was easily removed. | The same as left | No adhesion | Although sludge began to adhere. It was easily removed. | The same as left | No adhesion |
| 2 weeks | Sludge was removed by a bamboo broom and wiping | Although sludge was removed by a bamboo broom and wiping, it was not easily removed from the drain circuit portion. Removal was more difficult than the resin produced by Company A. | No adhesion | Sludge was removed by a bamboo broom and wiping | The same as left | No adhesion |
| 1 month | The solidified sludge was removed by a wooden hammer | The same as left. Removal of sludge was still more difficult than the resin produced by Company A. | Although sludge began to adhere to a high-temperature protion, it was partially separated. This was possibly caused by the problem with respect to adhesion | The solidified sludge was not easily removed by a wooden hammer. | The same as left | No adhesion |
| 2 months | The sludge which adhered to the whole surface was removed by hammering with difficulty. | The same as left The sludge was harder than that of the resin produced by Company A. | The sludge was extensively separated, and the solution entered the gap and was solidified. | The sludge which adhered to the whole surface was not easily removed by a wooden hammer | The same as left | No adhesion |
| 3 months | The sludge was solidified over the whole surface. | The same as left | The separated portion of the sludge was extended. | The sludge adhered to the whole surface and was solidified to a large degree. | The same as left | No adhesion |
| 4 months | Since sludge adhered to and grew over the whole surface, the ability as a heat exchanger deteriorated | The same as left | The same as left | Since sludge adhered to and grew over the whole surface, the ability as a heat exchanger deteriorated | The same as left | No adhesion |
| 6 months | Since sludge adhered to and grew over the whole surface, the ability as a heat exchanger significantly deteriorated | The same as left | The same as left | Since sludge adhered and grew over the whole surface, the ability as a heat exchanger significantly deteriorated | The same as left | No adhesion |

TABLE 2

| Item | Unit | ASTM Test Method | Fluororesine used in this invention | ETFE | PTFE | FEP | PFA |
|---|---|---|---|---|---|---|---|
| Physical Property | | | | | | | |
| Specific gravity | | D792 | 1.70 | 1.73–1.74 | 2.14–2.20 | 2.12–2.17 | 2.12–2.17 |
| Melting point | °C. | | 240 | 265–270 | 327 | 253–282 | 302–310 |
| Mechanical property | | | | | | | |
| Tensile test | $kg/cm^2$ | D638 | 478 | 410–470 | 280–350 | 200–320 | 320 |
| Elongation | % | D638 | 280 | 190–220 | 200–400 | 250–330 | 280–300 |
| Impact Strength (Izod) | kg · /cm/cm | D256 | Not broken | Not broken | 16.3 | Not broken | Not broken |
| Hardness | Rockwell | D785 | R96 or higher | R50 | R25 | D60 | D60 |
| Hardness | Durometer | D2240 | D73 | D75 | D55 | — | — |
| Coefficient of static friction | | — | 0.25 | — | 0.05 | — | — |
| Coefficient of dynamic friction (7 $kg/cm^2$ 3 m/min.) | | — | — | 0.4 | 0.10 | 6.2 | 6.2 |
| Thermal property | | | | | | | |
| Heat conductivity | $10^4$ Cal/cm · sec · °C. | C177 | 4.5 | 5.7 | 5.9 | 6.2 | 6.2 |
| Specific heat | Cal/°C./g | Laser flash | 0.44 | 0.47 | 0.25 | 0.28 | 0.28 |
| Coefficient of linear expansion | $10^3$/°C. | D696 | 7.5–8.0 | 3.4 (with filler) | 9.9 | 12 | 12 |
| Continuous use temperature | °C. | — | 178 | 180 | 260 | 260 | 260 |
| Electric property | | | | | | | |
| Volume resistivity | Q · cm | D257 | $7.5 \times 10^{15}$ | $>10^{16}$ | $>10^{16}$ | $>10^{16}$ | $>10^{16}$ |
| Surface resistivity | Ω | D257 | $3 \times 10^{14}$ | $>10^{14}$ | $>10^{16}$ | $>10^{13}$ | $>10^{16}$ |
| Dielectric strength | (1/8 in. thick) KV/mm | D149 | 31 | 16 | 16–24 | 20–24 | 20–24 |
| Dielectric constant 60 Hz | | D150 | 2.68 | 2.6 | <2.1 | 2.1 | 2.1 |
| Dielectric constant $10^3$ Hz | | " | — | 2.6 | <2.1 | 2.1 | 2.1 |
| Dielectric constant $10^4$ Hz | | " | — | 2.6 | <2.1 | 2.1 | 2.1 |
| Dielectric dissipation factor 60 Hz | | D150 | 0.00197 | 0.0006 | <0.0002 | <0.0002 | <0.0002 |
| Dielectric dissipation factor $10^3$ Hz | | " | — | 0.0008 | <0.0002 | <0.0002 | <0.0002 |
| Dielectric dissipation factor $10^4$ Hz | | " | — | 0.005 | <0.0002 | <0.0002 | <0.0003 |
| Arc resistance | sec | D495 | — | 75 | >300 | >300 | >300 |
| Durability | | | | | | | |
| Chemical resistance | | D543 | Excellent | Excellent | Excellent | Excellent | Excellent |
| Combustion property | | D635 | Incom-bustible | Incom-bustible | Incom-bustible | Incom-bustible | Incom-bustible |
| Water absorption | % | D570 | 0.01 | <0.01 | <0.01 | <0.01 | 0.03 |

TABLE 3

Irregular abrasion (Taper abrasion)
Method by taper test according to the test method of ASTM D 1044–56
Abrasion ring: CS-17 Load: 1 kg Number of rotation: 1000
Abrasion loss: Expressed in mg

| | Taper abrasion | Specific gravity | Thickness | *1 | *2 |
|---|---|---|---|---|---|
| Fluororesin of this invention | 8.7 | 1.70 | 1000μ | 67 | 52 |
| PTFE | 11.5 | 2.2 | 40μ | 1.6 | 1.2 |
| FEP | 14.8 | 2.15 | 40μ | 1.3 | 1 |
| ETFE | 13.4 | 1.73 | 800μ | 35 | 27 |

All values were obtained by measurement of coating films.

*1 average thickness + (taper abrasion + specific gravity
*2 Ratios to the value of 1.3 of FEP.

As obvious from Table 1, although neither adhesion of sludge nor separation of the fluororesin F coating layer occurred in the heat exchanger R according to the embodiment of the present invention, sludge strongly adhered to the surfaces in all heat exchangers of comparative examples, and the layers were separated in some of the examples. In the embodiment of the present invention, combination of the thickness of the fluororesin coated layer, the method of forming the layer (three-layer coating and burning) and the characteristics of the fluororesin possibly prevents adhesion of sludge and separation of the layer. The comparative examples possibly lack any one of these factors.

Although the above embodiment relates to the plate-formed heat exchanger R, even if the present invention is applied to a boil type or laminate type heat exchanger, the same effects as those described above can be obtained. In addition, the structure of the plate-formed heat exchanger is not limited to that shown as an example in the drawings, and a structure comprising two opposite passage plates 2 in which symmetrical passages are formed, or other structures may be used.

As described above, in the present invention, a fluororesin having the predetermined physical, mechanical, thermal and electrical properties is coated on the surface of a heat exchanger. The present invention thus has the remarkable effect of preventing the adhesion of sludge and the separation of the coating, which are caused in a heat exchanger coated with a general fluororesin.

As a result, the heat exchanger of the present invention does not require the work of removing sludge, which is essential to conventional immersion type heat exchangers, and is thus very suitable as an immersion type heat exchanger.

What is claimed is:

1. An immersion type heat exchanger comprising an outer surface coated with a fluororesin having a Rockwell hardness of at least R96, a taper abrasion less than 8.7 mg, a linear expansion coefficient of 7.5 to $8.0\times10^{-5}$/°C., and an elongation of 223% to 280%.

2. The heat exchanger of claim 1 wherein said fluororesin comprises $(CF_2—CFCl)_n$.

3. The heat exchanger of claim 2 wherein said fluororesin further comprises cobalt in the amount of one to two weight percent.

4. The heat exchanger of claim 2 wherein said fluororesin has a thickness of 350μ to 550μ.

5. The heat exchanger of claim 2 wherein said fluororesin comprises a first layer having a thickness of about 100μ, a second layer having a thickness of about 200 μ, and a third layer having a thickness of about 100μ.

6. The heat exchanger of claim 1 wherein said fluororesin has a specific gravity of about 1.70, a melting point of about 240° C., a tensile strength of about 478 kg/cm$^2$, a heat conductivity of about $4.5\times10^{-4}$ Cal/cm·sec, and a specific heat of about 0.44 Cal/°C./g.

7. The heat exchanger of claim 6 wherein said fluororesin has a volume resistivity of about $7.5\times10^{15}\Omega$, a surface resistivity of about $3\times10^{14}\Omega$, and a dielectric breakdown strength of about 31 Kv/mm when said fluororesin is about one-eighth inch thick.

8. The heat exchanger of claim 1 wherein said fluororesin comprises a first layer having a thickness of about 100μ and formed at a temperature of 290° C. to 340° C., a second layer having a thickness of about 200μ and formed at a temperature of 270° C. to 300° C., and a third layer having a thickness of about 100μ and formed at a temperature of 270° to 300° C.

9. The heat exchanger of claim 1 wherein said heat exchanger is one of a plate type, a metallic coil type, a laminated plate type and a shell-and-tube type.

* * * * *